United States Patent [19]

Wood et al.

[11] Patent Number: 4,465,009

[45] **Date of Patent: * Aug. 14, 1984**

[54] VEE TYPE PLANING HULL FOR SMALL POWER BOATS

[75] Inventors: Forrest L. Wood, Flippin; Dale H. Jensen, Everton; Kenneth P. Poley, Yellville; Charles C. Hoover, Bull Shoals; Gary L. Wilson, Flippin, all of Ark.

[73] Assignee: Wood Manufacturing Co., Flippin, Ark.

[ * ] Notice: The portion of the term of this patent subsequent to Nov. 30, 1999 has been disclaimed.

[21] Appl. No.: 285,032

[22] Filed: Jul. 20, 1981

[51] Int. Cl.[3] ..... B63B 1/04

[52] U.S. Cl. ..... 114/56; 114/290

[58] Field of Search ..... 114/56, 290, 291, 288, 114/271; D12/300, 312, 314

[56] References Cited

U.S. PATENT DOCUMENTS

| | | | |
|---|---|---|---|
| D. 230,258 | 2/1974 | Allison | D12/314 |
| D. 235,530 | 6/1975 | Livingston | D12/314 |
| D. 236,332 | 8/1975 | Livingston | D12/312 |
| D. 244,518 | 5/1977 | Allison | D12/314 |
| D. 252,507 | 7/1979 | Wood | D12/312 |
| 3,216,389 | 11/1965 | Thorsen | 114/56 |
| 3,363,598 | 1/1968 | Mortrude | D12/314 |
| 4,193,369 | 3/1980 | Talamante, Jr. | 114/56 |
| 4,361,102 | 11/1982 | Wood et al. | 114/56 |

FOREIGN PATENT DOCUMENTS

| | | | |
|---|---|---|---|
| 1398929 | 12/1965 | France | 114/56 |

*Primary Examiner*—Trygve M. Blix
*Assistant Examiner*—Thomas J. Brahan
*Attorney, Agent, or Firm*—Colton & Stone, Inc.

[57] ABSTRACT

High speed turning characteristics of a small vee type planing hull are increased by the use of after, outboard running surfaces which are concavely configured.

3 Claims, 4 Drawing Figures

VEE TYPE PLANING HULL FOR SMALL POWER BOATS

BACKGROUND OF THE INVENTION

The invention relates to open power boats of the type used in fishing tournaments and other recreational boating and particularly to the hull configuration thereof.

In those smaller vee entry boats rated for 115 h.p. but yet having top speeds in excess of 50 mph, with which the invention is particularly concerned, the choice of hull configuration has conventionally involved various trade offs among the more desirable criteria which include safety and fuel economy on the one hand and high speed performance on the other. These trade offs are no where more evident, in a conventional vee planing hull, than in a sharp course correction from "full out" on plane running where, from the standpoint of safety, it is necessary to come substantially off speed to achieve the increased wet planing area necessary for turn tracking stability. This, of course, produces a significant increase in drag with a concomitant decrease in fuel efficiency both in the turning maneuver and bringing the boat back to full plane after the course correction. It is the purpose of the invention to resolve these conventional trade offs as related to high speed course correction.

High speed turns are one of the more dangerous boating maneuvers and are particularly unforgiving of the novice boater who has not mastered the "feel" for coordinating trim and throttle adjustments at the inception, and execution, of the turn. Indeed, it is the rare expert who, even when throttling back from top speed and entering a proper trim adjustment, has not felt unanticipated stern slippage or "chine walk".

The prudent boater thus comes drastically off speed to execute a sharp turn. The decrease in speed, of course, results in a greater wetted area of the hull, puts more chines in the water and, most importantly, reduces the magnitude, or arc, of the lay over angle which the outer running surface of the hull on the inside of the turn makes with the water surface. The consequence of the latter is that with a lesser arc of downward movement in a given time frame the laying over of the outer running surface into wetting contact does not produce the violent slapping and bouncing from the surface that initiates repeated slapping impacts and violent stern slippage that is characteristic of a high speed turn under full throttle where the arc of descent is substantially greater from the full on plane position.

The foregoing is the typical performance of conventional vee hulls having the usual planar running surfaces, separated by chines, on either side of the keel line running surface which lateral, planar running surfaces and the central keel line running surface, when viewed in transverse section adjacent the aft end of the boat, exhibit a typical V shape terminating, laterally, at outer chines continuous with the sides of the boat.

As related to the present invention, it is important to note that prior art hulls of the type herein contemplated have employed planar, outboard running surfaces to more easily "slip" the water and avoid low speed cavitation.

Atypical hull configurations such as shown in U.S. Pat. No. 3,216,389 where all the running surfaces are concave are distinguishable in kind from the high performance type hulls herein described since inherent hull cavitation over the entire speed range of such a boat is inconsistent with the purposes of the present invention which is directed to performance parameters in that speed range beyond the reach of such atypical hulls.

SUMMARY OF THE INVENTION

A deep vee entry hull tapers aft to a more flattened V shape amidship and transitions rearwardly thereof to terminate in a modified gull wing appearance, viewed in cross section, as a consequence of the outer running surfaces being concavely configured in the after portions thereof. The result is that, in the after portion of the hull, the lateral outermost portion of the hull extends well below a straight line extrapolation of the mid portion of the aft hull configuration defined by the central keel running surface and the planar, inboard running surfaces.

The outermost portions of the outer concave running surfaces at the aft end of the hull, therefore, have a lesser clearance above the water line on plane and make wetted contact early on in a turning maneuver after moving through a lesser lay over arc than is the case with a conventional vee hull. This initial wetting contact is one of gradually increasing resistance as the turn is tightened rather than an immediate impact along a broad planar surface so that the tendency to "chine walk" or skid is reduced as a function of the shape of the concavity. In addition to reducing impact "bounce", the concave running surface on the inside of the turn funnels outflowing water smoothly away from the central portion of the hull and imparts a downward component to the lateral outflow which produces an upward, turn stabilizing force on the stern at the inside of the turn making it possible to dispense with the use of after wedges to control porpoising since, in the small, low horsepower boat with which the invention is concerned, the additional drag imposed by after wedges defeats the ability of the 115 h.p. propulsion unit to maintain speeds in excess of 50 mph in a turn. As the turn is further tightened to maximum the increasing submergence of the concave running surface produces a more than linear increased resistance to stern skid as a function of the greater reach and shape of the concave running surface "digging in" as compared with a conventional, planar running surface. Since these turning maneuvers involve, in effect, a yawing movement of the boat initiated from the stern, it is essential that the bow of the boat present minimal resistance to such movement which explains the necessity for transitioning the outer running surfaces from planar, forward to concave, aft with the transition being effected approximately amidship.

The maneuverability and particularly the turning capabilities of the hull herein disclosed are truly astounding. Production models of the present hull design are routinely put through 50 mph 360° turns without throttle or trim adjustments. Chine walk on turn is virtually eliminated.

DESCRIPTION OF THE DRAWINGS

The drawings are substantially to scale.

DESCRIPTION OF THE PREFERRED EMBODIMENT

Figure 2:
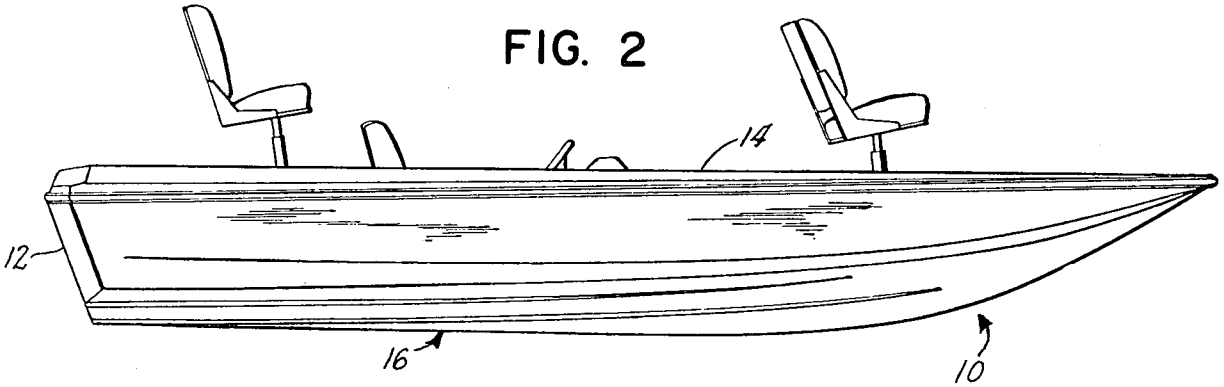
FIG. 2 is a side elevation of the power boat shown in FIG. 1.
Figure 1:
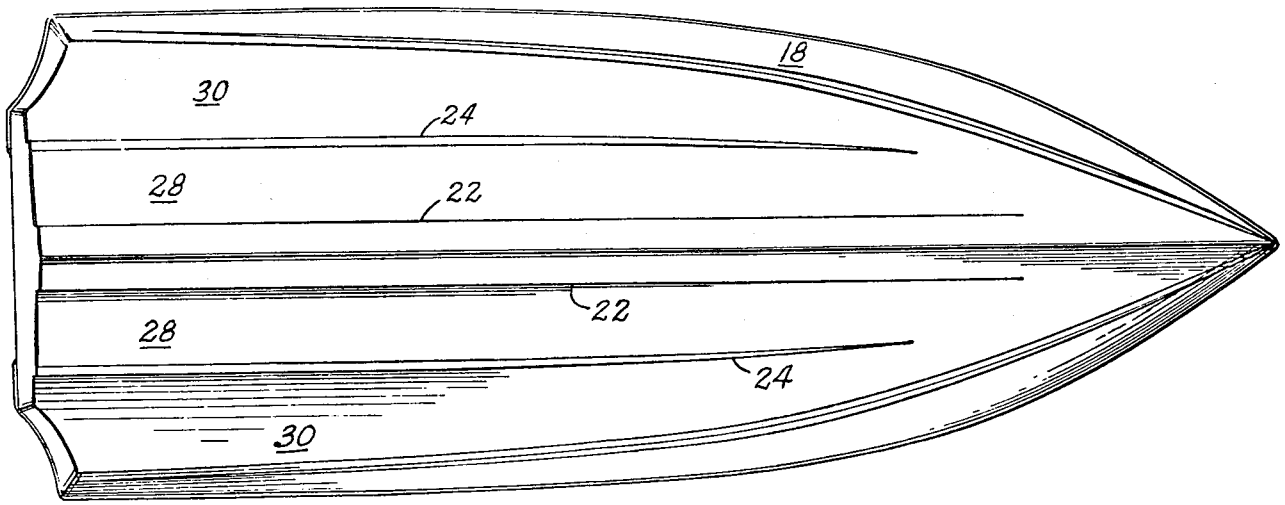
FIG. 1 is a bottom plan view of a power boat incorporating the hull of the present invention.

In FIGS. 1–4 is illustrated an open power boat 10, adapted to be driven by an outboard propulsion unit (not shown) mounted to transom 12, including a deck portion 14 surmounting the novel deep vee entry hull 16 which is the subject matter of the present invention.

The purpose of the novel hull construction is to facilitate high speed turning maneuvers.

Hull 16 includes side walls 18 in which are integrally formed spray rails 20 extending forward from immediately adjacent the stern to terminate at the bow immediately adjacent the gunwale. The under surface of hull 16 includes central, and outboard chine pairs 22, 24, extending forward from the stern to terminate short of the bow.

Figure 3:
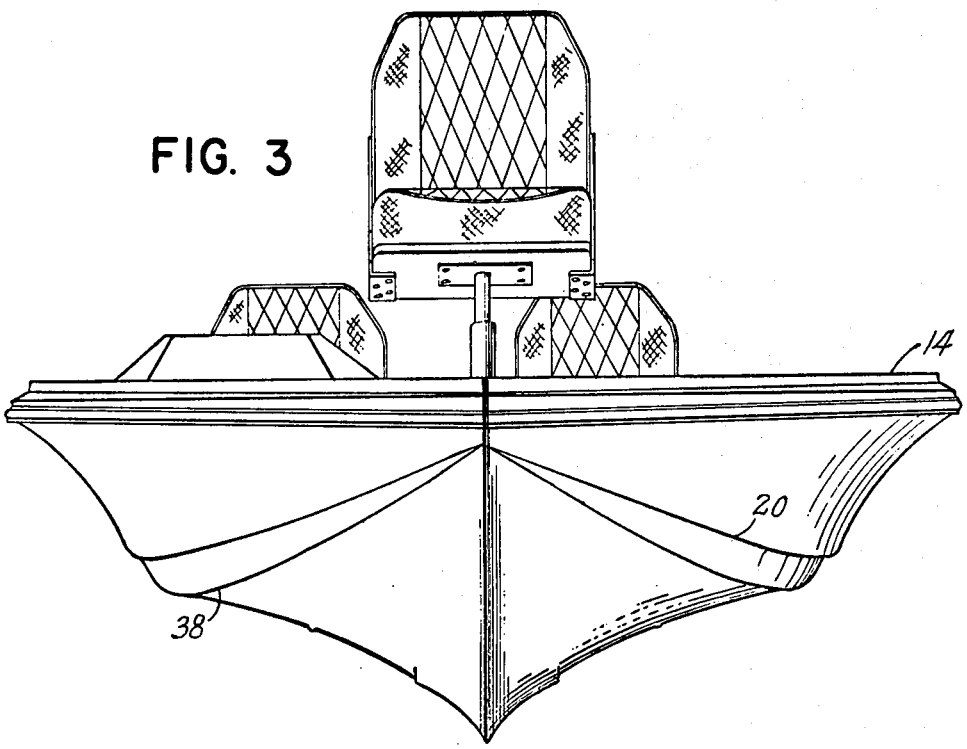
FIGS. 3 and 4 are front and rear elevations, respectively, of the power boat.
Figure 4:
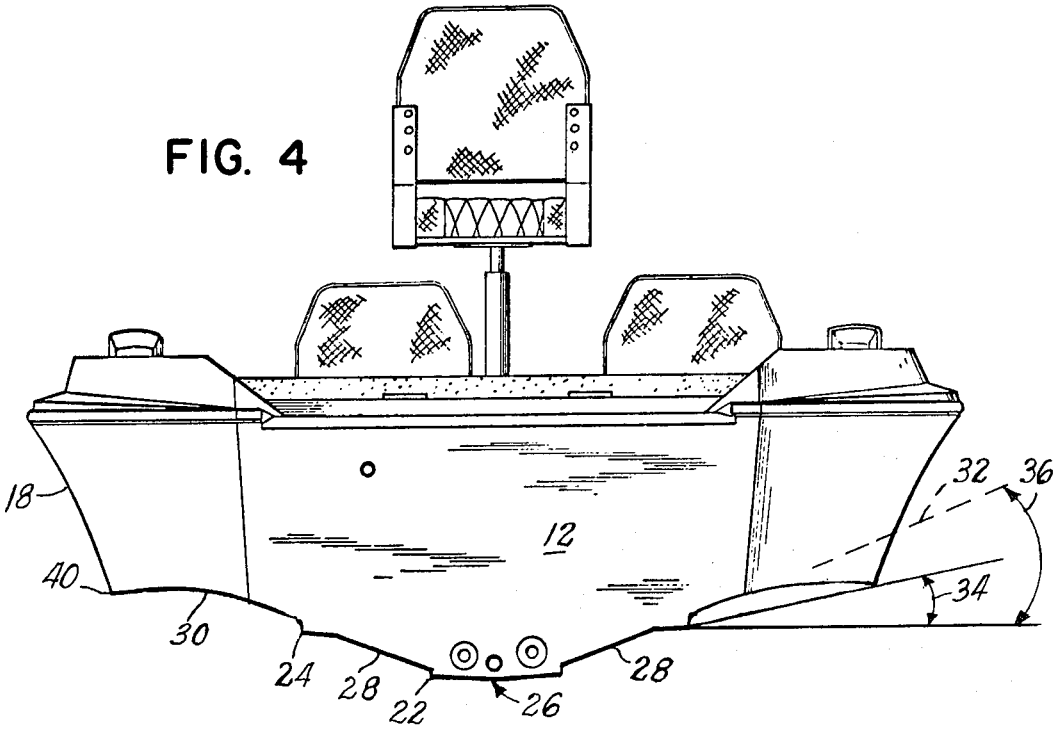

The deep vee entry portion of the hull is best shown in FIG. 3 while the gradual flattening of the V configuration moving from bow to stern is best seen in FIG. 2.

The after centerline keel portion, or central running surface, 26 is flanked by planar, central running surface 28 respectively delimited outboard by chine pairs 24. The outboard running surfaces 30, which play an important role in the present invention, are formed with a gradually increasing concavity from amidship aft. The maximum concavity being exhibited at the stern where, from FIG. 4, it will be seen that the generally V shaped cross section has transitioned to a modified gull wing shape due to the presence of the concave running surfaces 30 outboard of the planar running surfaces 28. This "gull wing" appearance is in sharp contrast with the stern appearance of a conventional vee hull whose outer, planar running surfaces comprise a straight line extrapolation of the inboard, planar running surfaces 28 as indicated by the phantom line 32 in FIG. 4. It will be seen that not only is the arc 34 of the "gull wing" lay over angle substantially less than arc 36 of the conventional lay over angle but the result of the concave shape is to enter the water, on turn, with a gradually increasing resistance thus avoiding the instantaneous, rebound producing slap or impact associated with outer, planar running surfaces. The result is substantial elimination of "chine walk" as yaw torquing moment is gradually increased upon tightening of the turn as a function of the outboard edge of the concave running surface "digging in" which latter "digging in" description is defeated by conventional slapping rebound.

It will be noted that the outer running surfaces terminate outboard, in the after portion of the hull (FIG. 4), in a smooth continuation of the concave configuration rather than terminating at an abrupt chine line as is conventional although it will also be noted that the forward ends of the outboard running surfaces 30, in the forward planar portions thereof, terminate outboard in the usual chine 38 which extends from a merger amidship with the lip 40 of outer running surface 30 forwardly to the bow. While it is clear that the function of bow chines 38, at least along the wetted portions thereof in a slow speed mode, are conventional; it is not fully understood just why its aft termination, where the concave portion of running surfaces 30 commence, is important but tests have confirmed this fact. It is hypothesized that the more abrupt downward curvature, as produced by a chine, at the outboard lip 40 of outer running surface 30 at the aft end thereof produces more lifting torque on the inside of a high speed turn than is consistent with the desired submergence rate of the outer lip 40 as the turn is tightened.

What is claimed is:

1. A deep vee entry hull having a central running surface extending fore and aft thereof, the cross section thereof transitioning from a pronounced vee to a nearly planar configuration from fore to aft, said central running surface being flanked, in the after portion of the hull, by intermediate and outboard running surfaces; said intermediate running surfaces being planar and exhibiting, with said central running surface a vee configuration in cross section; and said outboard running surfaces exhibiting a cross section of uninterrupted concave curvature commencing amidship to the extreme aft exit end thereof; the hull including side walls and the curvature of said concave outboard running surfaces, at any given fore and aft position, is constant up to and including an outer lip merging the same with the hull side walls; said outboard running surfaces being planar in the forward portion of the hull and transitioning to said concave configuration amidship; and the depth of said concave configuration gradually increasing from amidship to stern.

2. The hull of claim 1 including outboard bow chines extending aft from the bow of said hull and merging amidship with the outer lips of said outer concave running surfaces.

3. The hull of claim 2 wherein said deep vee entry hull tapers aft to a more flattened shape amidship and transitions rearwardly thereof to terminate in a modified gull wing appearance in cross section as a function of the concave outer running surfaces.

* * * * *